US011753921B2

(12) United States Patent
Groover et al.

(10) Patent No.: US 11,753,921 B2
(45) Date of Patent: *Sep. 12, 2023

(54) METHOD AND APPARATUS FOR IDENTIFYING A POTENTIAL PROBLEM WITH A BOTTOM HOLE ASSEMBLY (BHA) COMBINATION USING A FEEDBACK CONTROL LOOP SYSTEM

(71) Applicant: Nabors Drilling Technologies USA, Inc., Houston, TX (US)

(72) Inventors: Austin Groover, Spring, TX (US); Scott Coffey, Houston, TX (US); Drew Curran, Houston, TX (US); Adam Lacroix, Cypress, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/878,623

(22) Filed: Aug. 1, 2022

(65) Prior Publication Data

US 2022/0364456 A1 Nov. 17, 2022

Related U.S. Application Data

(63) Continuation of application No. 17/039,061, filed on Sep. 30, 2020, now Pat. No. 11,434,742.

(51) Int. Cl.

*E21B 44/00* (2006.01)
*E21B 44/06* (2006.01)
(Continued)

(52) U.S. Cl.

CPC ..... *E21B 44/00* (2013.01); *E21B 21/08* (2013.01); *E21B 44/06* (2013.01); *E21B 47/06* (2013.01); *E21B 47/095* (2020.05)

(58) Field of Classification Search

CPC ..... E21B 44/00; E21B 21/08; E21B 44/06; E21B 47/06; E21B 47/095; E21B 47/12
See application file for complete search history.

(56) References Cited

U.S. PATENT DOCUMENTS 8,256,534 B2 * 9/2012 Byreddy ..... E21B 44/00 175/45
11,434,742 B2 * 9/2022 Groover ..... E21B 47/095
(Continued)

*Primary Examiner* — Brad Harcourt
(74) *Attorney, Agent, or Firm* — Haynes and Boone, LLP

(57) ABSTRACT

An apparatus for, and method of identifying a potential problem with a bottom hole assembly ("BHA") combination that is used in a drilling operation. The method includes monitoring, using a sensor, an actual drilling parameter; comparing the actual drilling parameter to a target drilling parameter to determine a deviation; creating, in response to the deviation and by a feedback control loop system that references an electronic database, instructions thereby omitting variability associated with human input in creating the instructions; monitoring, using the controller, a change in the deviation; determining that the change in the deviation is below a threshold; and determining, based on the change in the deviation being below the threshold, that there is a potential problem with the BHA combination. The BHA combination comprises a mud motor and a drill bit.

20 Claims, 8 Drawing Sheets

(51) Int. Cl.

| | |
|---|---|
| ***E21B 21/08*** | (2006.01) |
| ***E21B 47/06*** | (2012.01) |
| ***E21B 47/095*** | (2012.01) |

(56) References Cited

U.S. PATENT DOCUMENTS

| | | | | |
|---|---|---|---|---|
| 2017/0044857 | A1 | 2/2017 | Leuchtenberg | |
| 2017/0218744 | A1 | 8/2017 | Dykstra et al. | |
| 2017/0350229 | A1 | 12/2017 | Hoehn et al. | |
| 2020/0063546 | A1 | 2/2020 | Weideman et al. | |
| 2020/0181981 | A1 | 6/2020 | Miller | |
| 2022/0003106 | A1* | 1/2022 | Benson | G05B 19/048 |
| 2022/0098968 | A1 | 3/2022 | Groover et al. | |

* cited by examiner

METHOD AND APPARATUS FOR IDENTIFYING A POTENTIAL PROBLEM WITH A BOTTOM HOLE ASSEMBLY (BHA) COMBINATION USING A FEEDBACK CONTROL LOOP SYSTEM

CROSS-REFERENCE TO A RELATED APPLICATION

This application is a continuation of U.S. patent application Ser. No. 17/039,061, filed Sep. 30, 2020, now allowed, the entire contents of which is hereby incorporated herein by express reference thereto.

FIELD OF THE DISCLOSURE

The disclosure herein relates to methods and apparatuses adapted to identify potential problems with drilling equipment using a feedback control loop system, and to address such potential problems.

BACKGROUND

At the outset of a drilling operation, drillers typically establish a drilling plan that includes a target location and a drilling path, or well plan, to the target location. Once drilling commences, the bottom hole assembly is directed or "steered" from a vertical drilling path in any number of directions, to follow the proposed well plan. For example, to recover an underground hydrocarbon deposit, a well plan might include a vertical well to a point above the reservoir, then a directional or horizontal well that penetrates the deposit. The drilling operator may then steer the bit through both the vertical and horizontal aspects in accordance with the plan.

Conventionally, a drilling operator steers the bottom hole assembly ("BHA") using a computer system and instructions generated by a drilling plan. For instructions relating to a slide drilling operation, the instructions may include a course length (distance to slide drill) at a toolface direction (0-360 degrees magnetic or 0-180 degrees gravity to orient the downhole bent motor housing). In order to complete the course length at the toolface direction provided, the drilling operator controls a variety of drilling parameters. The drilling operator, using his or her judgment, may alter one or more drilling parameters based on the responsiveness of the BHA and the downhole conditions, which introduces substantial variability into the control process between discrete slides, hole sections, wells, locations, and directional drillers. Due to the amount of variability in the control process, equipment performance is difficult to monitor and thus optimize.

Thus, an automated drilling system that removes the substantial variability associated with the drilling operator is needed to identify potential problems with the drilling equipment.

SUMMARY OF THE INVENTION

In some embodiments, the present inventions includes a method of identifying a potential problem with drilling equipment that is used in a drilling operation associated with a wellbore, wherein the method includes: monitoring, using a sensor, an actual drilling parameter associated with the drilling operation; comparing, using a controller that is operably coupled to the sensor, the actual drilling parameter to a target drilling parameter to determine a deviation between the actual and target drilling parameters; creating, using the controller and in response to the deviation, instructions for a control system that controls an aspect of the drilling operation; wherein the controller is operably coupled to the control system; wherein the controller, the control system, and the sensor form a feedback control loop system such that the controller creates the instructions to reduce the deviation and causes the control system to implement the instructions; and wherein the controller references an electronic database to create the instructions; drilling, using the instructions and the controller, the wellbore; monitoring, using the controller, a change in deviation in response to drilling using the instructions; determining that the change in deviation is below a threshold; wherein the change in deviation being below the threshold is associated with a decrease in drilling performance; and determining, based on the change in deviation being below the threshold, that there is a potential problem with the drilling equipment. In some embodiments, the actual drilling parameter is any one or more of: a rate of penetration; a differential pressure; and a toolface. In some embodiments, the threshold is based on any one or more of: data created during the drilling operation and data associated with an offset wellbore that is offset from the wellbore; and wherein the controller referencing the electronic database to create the instructions omits variability associated with human input in creating the instructions thereby resulting in the change in deviation being less than the threshold being associated with the potential problem with the drilling equipment. In some embodiments, the decrease in drilling performance includes a decrease in toolface control precision and the threshold is based on toolface control precision of the offset wellbore; or wherein the decrease in drilling performance comprises a decreased rate of penetration and the threshold is based on a rate of penetration of the offset wellbore. In some embodiments, the method also includes identifying, using the controller, a recommendation in response to the potential problem; wherein the drilling equipment is a drilling bit; and wherein the change in deviation relates to a decline in a rate of penetration and the recommendation is to change the drilling bit. In some embodiments, the method also includes identifying, using the controller, a recommendation in response to the potential problem; wherein the drilling equipment is a mud motor; and wherein the decrease in drilling performance includes a decline in differential pressure for a given weight on bit and the recommendation is to change the mud motor. In some embodiments, the method also includes identifying, using the controller, a recommendation in response to the potential problem; wherein the drilling equipment is a mud motor; and wherein the decrease in drilling performance includes a decline in stability of a differential pressure and the recommendation is to change the mud motor. In some embodiments, the method also includes displaying an alert regarding the potential problem on a user interface, wherein the alert includes a recommendation to modify the instructions. In some embodiments, the method also includes displaying an alert regarding the potential problem on a user interface, wherein the alert includes a recommendation to change the drilling equipment. In some embodiments, the method also includes: identifying, using the controller, a recommendation in response to the potential problem; and implementing, using the controller, the recommendation without waiting for human input.

In some embodiments, the present invention includes a drilling apparatus configured to identify a potential problem with drilling equipment that is used in a drilling operation associated with a wellbore, the apparatus comprising: a drill string comprising a plurality of tubulars and a bottom hole assembly (BHA) operable to perform the drilling operation; a sensor that monitors an actual drilling parameter during the drilling operation; a control system that controls an aspect of the drilling operation; and a controller that is operably coupled to the sensor, wherein the controller is configured to: monitor, using data from the sensor, the actual drilling parameter associated with the drilling operation; compare the actual drilling parameter to a target drilling parameter to determine a deviation between the actual and target drilling parameters; create, in response to the deviation, instructions for the control system; wherein the controller references an electronic database to create the instructions; control the control system to drill, using the instructions, the wellbore; monitor a change in deviation in response to drilling using the instructions; determine that the change in deviation is below a threshold; wherein the change in deviation being below the threshold is associated with a decrease in drilling performance; and determine, based on the change in deviation being below the threshold, that there is a potential problem with the drilling equipment. In some embodiments, the actual drilling parameter is any one or more of: a rate of penetration; a differential pressure; and a toolface. In some embodiments, the threshold is based on any one or more of: data created during the drilling operation and data associated with an offset wellbore that is offset from the wellbore; and wherein the controller referencing the electronic database to create the instructions omits variability associated with human input in creating the instructions thereby resulting in the change in deviation being less than the threshold being associated with a potential problem with the drilling equipment. In some embodiments, the decrease in drilling performance includes a decrease in toolface control precision and the threshold is based on toolface control precision of the offset wellbore; or wherein the decrease in drilling performance includes a decreased rate of penetration and the threshold is based on a rate of penetration of the offset wellbore. In some embodiments, the controller is further configured to identify a recommendation in response to the potential problem; wherein the drilling equipment is a drilling bit; and wherein the change in deviation relates to a decline in a rate of penetration and the recommendation is to change the drilling bit. In some embodiments, the controller is further configured to identify a recommendation in response to the potential problem; wherein the drilling equipment is a mud motor; and wherein the decrease in drilling performance includes a decline in differential pressure for a given weight on bit and the recommendation is to change the mud motor. In some embodiments, the controller is further configured to identify a recommendation in response to the potential problem; wherein the drilling equipment is a mud motor; and wherein the decrease in drilling performance includes a decline in a stability of a differential pressure and the recommendation is to change the mud motor. In some embodiments, the controller is further configured to display an alert regarding the potential problem on a user interface, wherein the alert includes a recommendation to modify the instructions. In some embodiments, the controller is further configured to display an alert regarding the potential problem on a user interface, wherein the alert includes a recommendation to change the drilling equipment. In some embodiments, the controller is further configured to: identify a recommendation in response to the potential problem; and implement the recommendation without waiting for human input.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF PREFERRED EMBODIMENTS

Figure 1:
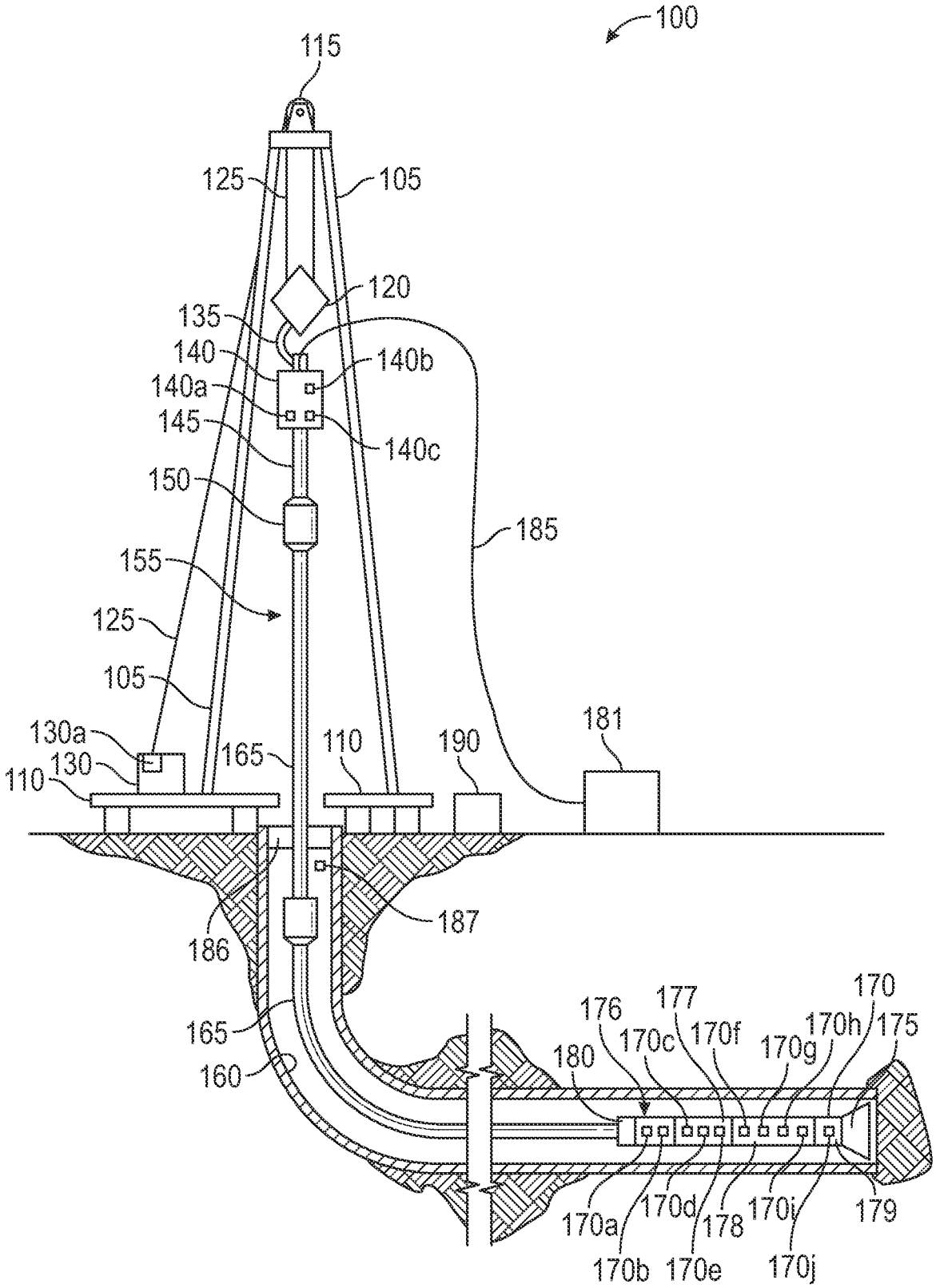
FIG. 1 is a schematic diagram of a drilling rig apparatus according to one or more aspects of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact and may also include embodiments in which additional features may be formed interposing the first and second features, such that the first and second features may not be in direct contact.

The apparatus and methods disclosed herein automate the alteration and execution of drilling instructions using data received from the subject drilling rig and from offset drilling rigs and a set of rules, which allows for the monitoring of equipment responsiveness and the identification of potential problems with the drilling equipment. Prior to drilling, a target location is typically identified, and an optimal wellbore profile or planned path is established. Such target well plans are generally based upon the most efficient or effective path to the target location or locations and are based on the data available at the time. As drilling proceeds, the apparatus and methods disclosed herein determine the position of the BHA, create instructions based on the position of the BHA and a plurality of rules, and execute the instructions. As the instructions are based on a plurality of rules instead of human input from a directional drilling, the responsiveness of the drilling equipment can be monitored and optimized. For example, the responsiveness of the BHA can indicate deterioration of the drilling equipment, such as the drilling bit. The drilling bit may be changed or the drilling bit may not be changed and the drilling operation may be altered to account for the condition of the drilling bit.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Generally, the apparatus 100 monitors, in real-time, drilling operations relating to a wellbore, creates and/or modifies drilling instructions based on the monitored drilling operations, monitors the responsiveness of drilling equipment used in the drilling operation, and identifies potential problems with drilling equipment based on the responsiveness. As used herein, the term "real-time" is thus meant to encompass close to real-time, such as within about 10 seconds, preferably within about 5 seconds, and more preferably within about 2 seconds. "Real-time" can also encompass an amount of time that provides data based on a wellbore drilled to a given depth to provide actionable data according to the present invention before a further wellbore being drilled achieves that depth. In some embodiments, the apparatus 100 provides a recommendation to the potential problem that has been identified with the drilling equipment.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to draw works 130, which is configured to reel out and reel in the drilling line 125 to cause the traveling block 120 to be lowered and raised relative to the rig floor 110. The draw works 130 may include a rate of penetration ("ROP") sensor 130*a*, which is configured for detecting an ROP value or range, and a controller to feed-out and/or feed-in of a drilling line 125. The other end of the drilling line 125, known as a dead line anchor, is anchored to a fixed position, possibly near the draw works 130 or elsewhere on the rig.

A hook 135 is attached to the bottom of the traveling block 120. A top drive 140 is suspended from the hook 135. A quill 145, extending from the top drive 140, is attached to a saver sub 150, which is attached to a drill string 155 suspended within a wellbore 160. Alternatively, the quill 145 may be attached to the drill string 155 directly.

The term "quill" as used herein is not limited to a component which directly extends from the top drive 140, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe or tubulars 165 and a BHA 170, which includes a drill bit 175. The BHA 170 may include one or more measurement-while-drilling ("MWD") or wireline conveyed instruments 176, flexible connections 177, optional motors 178, adjustment mechanisms 179 for push-the-bit drilling or bent housing and bent subs for point-the-bit drilling, a controller 180, stabilizers, and/or drill collars, among other components. One or more pumps 181 may deliver drilling fluid to the drill string 155 through a hose or other conduit 185, which may be connected to the top drive 140.

The downhole MWD or wireline conveyed instruments 176 may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, sent to the controller 180, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 is tripped out of the wellbore 160.

In an example embodiment, the apparatus 100 may also include a rotating blow-out preventer ("BOP") 186, such as if the wellbore 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 186. The apparatus 100 may also include a surface casing annular pressure sensor 187 configured to detect the pressure in the annulus defined between, for example, the wellbore 160 (or casing therein) and the drill string 155. It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

In the example embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 may include a downhole annular pressure sensor 170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160, which may also be referred to as the casing pressure, downhole casing pressure, MWD casing pressure, or downhole annular pressure. These measurements may include both static annular pressure (pumps off) and active annular pressure (pumps on). However, in other embodiments the downhole annular pressure may be calculated using measurements from a plurality of other sensors located downhole or at the surface of the well.

The apparatus 100 may additionally or alternatively include a shock/vibration sensor 170*b* that is configured for detecting shock and/or vibration in the BHA 170. The apparatus 100 may additionally or alternatively include a mud motor delta pressure (AP) sensor 170*c* that is configured to detect a pressure differential value or range across the one or more optional motors 178 of the BHA 170. In some embodiments, the mud motor AP may be alternatively or additionally calculated, detected, or otherwise determined at the surface, such as by calculating the difference between the surface standpipe pressure just off-bottom and pressure once the bit touches bottom and starts drilling and experiencing torque. The one or more motors 178 may each be or include a positive displacement drilling motor that uses hydraulic power of the drilling fluid to drive the bit 175, also known as a mud motor. One or more torque sensors, such as a bit torque sensor, may also be included in the BHA 170 for sending data to a controller 190 that is indicative of the torque applied to the bit 175.

The apparatus 100 may additionally or alternatively include a toolface sensor 170*e* configured to estimate or detect the current toolface orientation or toolface angle. The toolface sensor 170*c* may be or include a conventional or future-developed gravity toolface sensor which detects toolface orientation relative to the Earth's gravitational field. Alternatively, or additionally, the toolface sensor 170*c* may be or include a conventional or future-developed magnetic toolface sensor which detects toolface orientation relative to magnetic north or true north. In an example embodiment, a magnetic toolface sensor may detect the current toolface when the end of the wellbore is less than about 7° from vertical, and a gravity toolface sensor may detect the current toolface when the end of the wellbore is greater than about 7° from vertical. However, other toolface sensors may also be utilized within the scope of the present disclosure, including non-magnetic toolface sensors and non-gravitational inclination sensors. The toolface sensor 170*c* may also, or alternatively, be or include a conventional or future-developed gyro sensor. The apparatus 100 may additionally or alternatively include a WOB sensor 170*f* integral to the BHA 170 and configured to detect WOB at or near the BHA 170. The apparatus 100 may additionally or alternatively include an inclination sensor 170*g* integral to the BHA 170 and configured to detect inclination at or near the BHA 170. The apparatus 100 may additionally or alternatively include an azimuth sensor 170*h* integral to the BHA 170 and configured to detect azimuth at or near the BHA 170. The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145. In some embodiments, the BHA 170 also includes another directional sensor 170*i* (e.g., azimuth, inclination, toolface, combination thereof, etc.) that is spaced along the BHA 170 from a first directional sensor (e.g., the inclination sensor 170*g*, the azimuth sensor 170*h*). For example, and in some embodiments, the sensor 170*i* is positioned in the MWD 176 and the first directional sensor is positioned in the adjustment mechanism 179, with a known distance between them, for example 20 feet, configured to estimate or detect the current toolface orientation or toolface angle. The sensors 170*a*-170*j* are not limited to the arrangement illustrated in FIG. 1 and may be spaced along the BHA 170 in a variety of configurations.

The top drive 140, the draw works 130, the crown block 115, the traveling block 120, drilling line or dead line anchor may additionally or alternatively include or otherwise be associated with a WOB or hook load sensor 140*c* (WOB calculated from the hook load sensor that can be based on active and static hook load) (e.g., one or more sensors installed somewhere in the load path mechanisms to detect and calculate WOB, which can vary from rig-to-rig) different from the WOB sensor 170*f*. The WOB sensor 140*f* may be configured to detect a WOB value or range, where such detection may be performed at the top drive 140, the draw works 130, or other component of the apparatus 100. Generally, the hook load sensor 140*c* detects the load on the hook 135 as it suspends the top drive 140 and the drill string 155.

The detection performed by the sensors described herein may be performed once, continuously, periodically, and/or at random intervals. The detection may be manually triggered by an operator or other person accessing a human-machine interface ("HMI") or GUI, or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

In some embodiments, the controller 180 is configured to control or assist in the control of one or more components of the apparatus 100. For example, the controller 180 may be configured to transmit operational control signals to the controller 190, the draw works 130, the top drive 140, other components of the BHA 170 such as the adjustment mechanism 179, and/or the pump 181. The controller 180 may be a stand-alone component that forms a portion of the BHA 170 or be integrated in the adjustment mechanism 179 or another sensor that forms a portion of the BHA 170. The controller 180 may be configured to transmit the operational control signals or instructions to the draw works 130, the top drive 140, other components of the BHA 170, and/or the pump 181 via wired or wireless transmission means which, for the sake of clarity, are not depicted in FIG. 1.

The apparatus 100 also includes the controller 190, which is or forms a portion of a computing system, configured to control or assist in the control of one or more components of the apparatus 100. For example, the controller 190 may be configured to transmit operational control signals to the draw works 130, the top drive 140, the BHA 170 and/or the pump 181. The controller 190 may be a stand-alone component installed near the mast 105 and/or other components of the apparatus 100. In an example embodiment, the controller 190 includes one or more systems located in a control room proximate the mast 105, such as the general-purpose shelter often referred to as the "doghouse" serving as a combination tool shed, office, communications center, and general meeting place. The controller 190 may be configured to transmit the operational control signals to the draw works 130, the top drive 140, the BHA 170, and/or the pump 181 via wired or wireless transmission means which, for the sake of clarity, are not depicted in FIG. 1.

In some embodiments, the controller 190 is not operably coupled to the top drive 140, but instead may include other drive systems, such as a power swivel, a rotary table, a coiled tubing unit, a downhole motor, and/or a conventional rotary rig, among others.

In some embodiments, the controller 190 controls the flow rate and/or pressure of the output of the mud pump 181.

In some embodiments, the controller 190 controls the feed-out and/or feed-in of the drilling line 125, rotational control of the draw works (in v. out) to control the height or position of the hook 135 and may also control the rate the hook 135 ascends or descends. However, example embodiments within the scope of the present disclosure include those in which the draw-works-drill-string-feed-off system may alternatively be a hydraulic ram or rack and pinion type hoisting system rig, where the movement of the drill string 155 up and down is via something other than the draw works 130. The drill string 155 may also take the form of coiled tubing, in which case the movement of the drill string 155 in and out of the hole is controlled by an injector head which grips and pushes/pulls the tubing in/out of the hole. Nonetheless, such embodiments may still include a version of the draw works controller, which may still be configured to control feed-out and/or feed-in of the drill string 155.

Generally, the apparatus 100 also includes a hook position sensor that is configured to detect the vertical position of the hook 135, the top drive 140, and/or the travelling block 120. The hook position sensor may be coupled to, or be included in, the top drive 140, the draw works 130, the crown block 115, and/or the traveling block 120 (e.g., one or more sensors installed somewhere in the load path mechanisms to detect and calculate the vertical position of the top drive 140, the travelling block 120, and the hook 135, which can vary from rig-to-rig). The hook position sensor is configured to detect the vertical distance the drill string 155 is raised and lowered, relative to the crown block 115. In some embodiments, the hook position sensor is a draw works encoder, which may be the ROP sensor 130*a*. In some embodiments, the apparatus 100 also includes a rotary RPM sensor that is configured to detect the rotary RPM of the drill string 155. This may be measured at the top drive 140 or elsewhere, such as at surface portion of the drill string 155. In some embodiments, the apparatus 100 also includes a quill position sensor that is configured to detect a value or range of the rotational position of the quill 145, such as relative to true north or another stationary reference. In some embodiments, the apparatus 100 also includes a pump pressure sensor that is configured to detect the pressure of mud or fluid that powers the BHA 170 at the surface or near the surface. In some embodiments, the apparatus also includes a MSE sensor that is configured to detect the MSE representing the amount of energy required per unit volume of drilled rock. In some embodiments, the MSE is not directly sensed, but is calculated based on sensed data at the controller 190 or other controller. In some embodiments, the apparatus 100 also includes a bit depth sensor that detects the depth of the bit 175.

Figure 2:
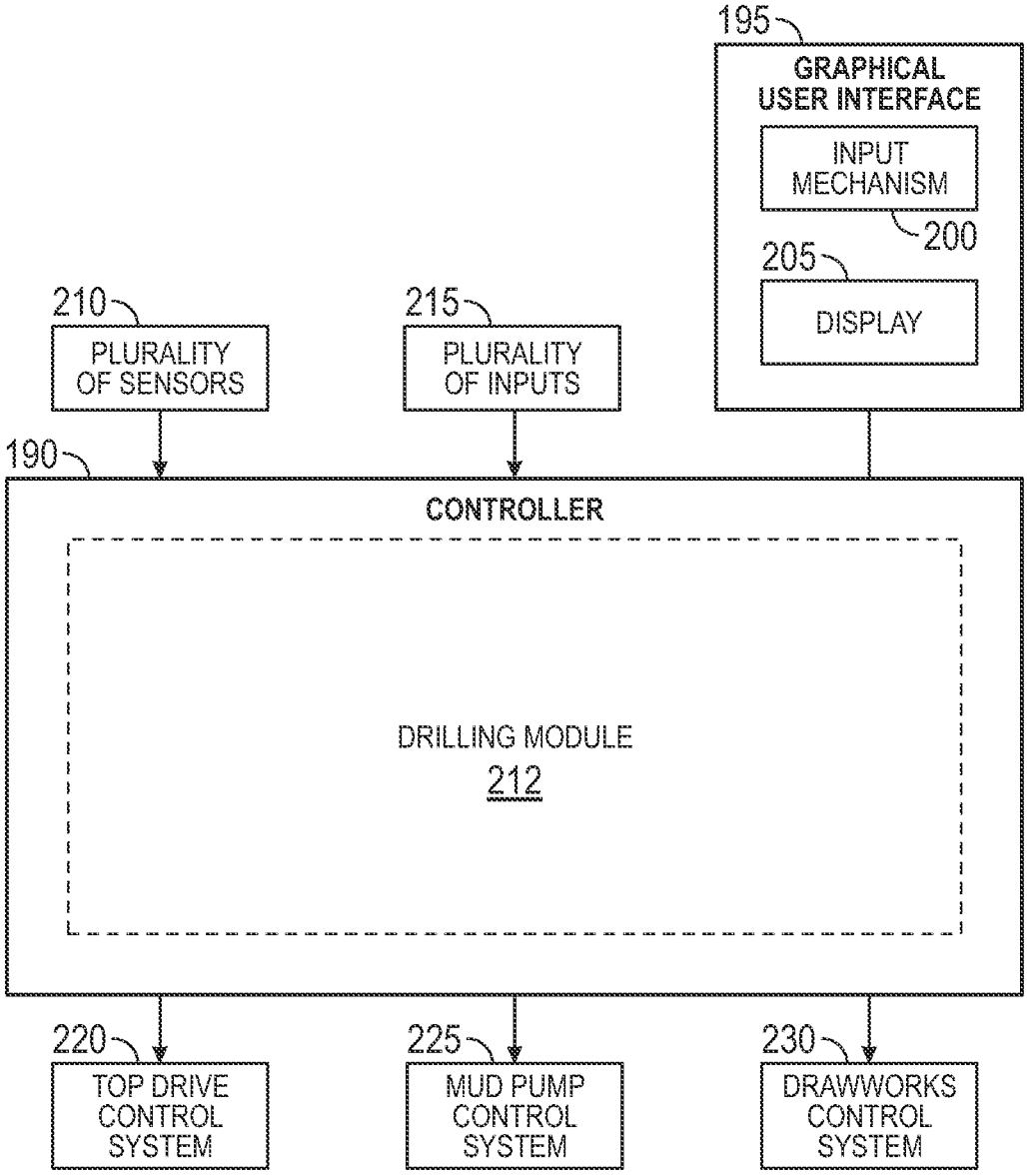
FIG. 2 is a schematic illustration of a portion of the apparatus of FIG. 1, according to one or more aspects of the present disclosure.

FIG. 2 is a diagrammatic illustration of a data flow involving at least a portion of the apparatus 100 according to one embodiment. Generally, the controller 190 is operably coupled to or includes a GUI 195. The GUI 195 includes an input mechanism 200 for user-inputs or drilling parameters. The input mechanism 200 may include a touch-screen, keypad, voice-recognition apparatus, dial, button, switch, slide selector, toggle, joystick, mouse, data base and/or other conventional or future-developed data input device. Such input mechanism 200 may support data input from local and/or remote locations. Alternatively, or additionally, the input mechanism 200 may include means for user-selection of input parameters, such as predetermined toolface set point values or ranges, such as via one or more drop-down menus, input windows, etc. Drilling parameters may also or alternatively be selected by the controller 190 via the execution of one or more database look-up procedures. In general, the input mechanism 200 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other means. The GUI 195 may also include a display 205 for visually presenting information to the user in textual, graphic, or video form. The display 205 may also be utilized by the user to input the input parameters in conjunction with the input mechanism 200. For example, the input mechanism 200 may be integral to or otherwise communicably coupled with the display 205. In some embodiments, the display 205 is arranged to present visualizations of a down hole environment, such as a two-dimensional visualization and/or a three-dimensional visualization. Depending on the implementation, the display 205 may include, for example, an LED or LCD display computer monitor, touchscreen display, television display, a projector, or other display device. The GUI 195 and the controller 190 may be discrete components that are interconnected via wired or wireless means. Alternatively, the GUI 195 and the controller 190 may be integral components of a single system or controller. The controller 190 is configured to receive electronic signals via wired or wireless transmission means (also not shown in FIG. 1) from a plurality of sensors 210 included in the apparatus 100, where each sensor is configured to detect an operational characteristic or parameter. The controller 190 also includes a drilling module 212 to control a drilling operation.

The drilling module 212 may include a variety of sub modules, with each of the sub modules being associated with a predetermined workflow or recipe that executes a task from beginning to end. Often, the predetermined workflow includes a set of computer-implemented instructions for executing the task from beginning to end, with the task being one that includes a repeatable sequence of steps that take place to implement the task. The drilling module 212 generally implements the task of completing a steering operation, which steers the BHA 170 along the planned drilling path; recommends and executes the addition of another stand to the drill string 155; recommends and executes the process of tripping out the BHA 170; among other operations. Generally, the instructions for executing a task are based on a plurality of rules. Using the data provided from the plurality of inputs and referencing the plurality of rules, the drilling module 212 can generate instructions that address trends in the data and keep the drilling operation within tolerances and/or windows. Examples of information generated and/or referenced by the drilling module 212 include a current slide score as a measure of the quality of the slide, a toolface distribution to target (e.g., percentage of toolface values within X degrees of the advisory toolface angle), resultant slide vector (e.g., the aggregate toolface direction of all toolface measurements throughout a single slide), current slide distance, remaining slide distance, bit proximity to steering line or steering window, average and current rate of penetration, qualitative information that describes the adherence of the as-drilled trajectory to the planned trajectory or input steering line, real-time information about the actual current inclination and azimuth of the BHA, as measured at the each stationary survey, and real-time information about the projected current inclination and azimuth of the bit, as well as other types of sensor data and feedback from various drilling systems. This information, and with reference to a plurality of rules, may be used to change drilling parameters controlled by the drilling module 212.

The drilling module 212 may be further configured to generate a control signal, such as via intelligent adaptive control, and provide the control signal to the top drive control system 220, the mud pump control system 225, and/or the draw works control system 230 to adjust and/or maintain the toolface orientation. For example, the drilling module 212 may provide one or more signals to the top drive control system 220 and/or the draw works control system 230 to increase or decrease WOB and/or quill position, such as may be required to accurately "steer" the drilling operation. In some embodiments, the controller 190 is also operably coupled to a top drive control system 220, a mud pump control system 225, and a draw works control system 230, and is configured to send signals to each of the control systems 220, 225, and 230 to control the operation of the top drive 140, the mud pump 181, and the draw works 130. However, in other embodiments, the controller 190 includes each of the control systems 220, 225, and 230 and thus sends signals to each of the top drive 140, the mud pump 181, and the draw works 130.

Figure 3:
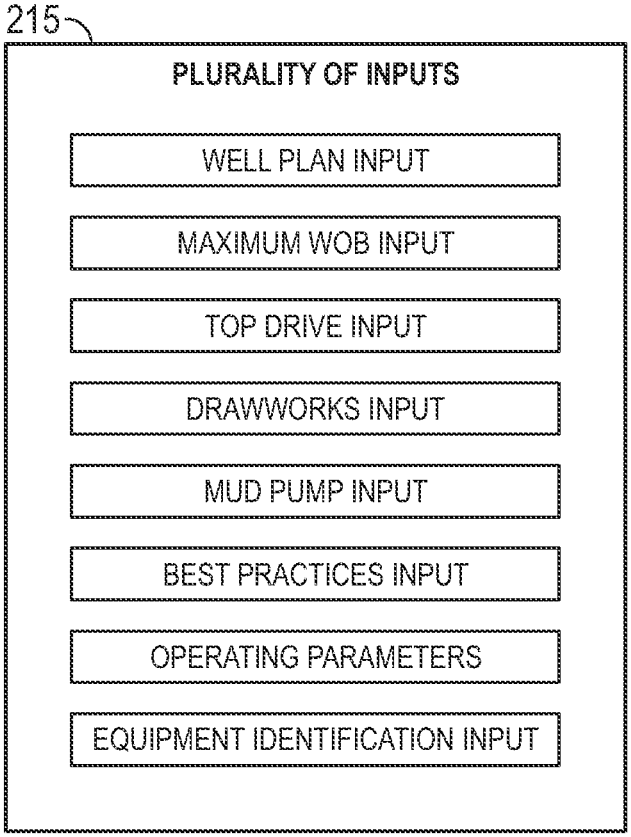
FIG. 3 is a listing of a plurality of inputs used by the drilling rig apparatus of FIG. 1, according to one or more aspects of the present disclosure.

The controller 190 is also configured to: receive a plurality of inputs 215 from a user via the input mechanism 200; and/or look up a plurality of inputs from a database. In some embodiments and as illustrated in FIG. 3, the plurality of inputs 215 includes the well plan input, a maximum WOB input, a top drive input, a draw works input, a mud pump input, best practices input, operating parameters, and equipment identification input, etc. In some embodiments, the plurality of operating parameters may include a maximum slide distance; a maximum dogleg severity; and a minimum radius of curvature. The plurality of operating parameters also includes orientation-tolerance window ("OTW") parameters, such as an inclination tolerance range and an azimuth tolerance range. The plurality of operating parameters also includes parameters that define an unwanted downhole trend, such as an equipment output trend parameters, geology trend parameters, and other downhole trend parameters. The plurality of operating parameters also includes location-tolerance window ("LTW") parameters, such as an offset direction, an offset distance, geometry, size, and dip angle. In some embodiments, the maximum slide distance may be zero. That is, no slides are recommended while the BHA 170 extends within a first formation type or during a specific period of time relative to the drilling process. The maximum slide distance is not limited to zero feet, but may be any number of feet or distance, such as for example 10 ft., 20 ft., 30 ft., 40, ft. 50 ft., 90 ft., etc. Generally, the maximum dogleg severity is the change in inclination over a distance and measures a build rate on a micro-level (e.g., 3°/100 ft.) while the minimum radius of curvature is associated with a build rate on a macro-level (e.g., 1°/1,000 ft.).

The orientation-tolerance window parameters include an inclination tolerance range and an azimuth tolerance range. In some embodiments, the inclination tolerance range and the azimuth tolerance range are associated with a location along the well plan and change depending upon the location along the well plan. That is, at some points along the well plan the inclination tolerance range and the azimuth tolerance range may be greater than the inclination tolerance range and the azimuth tolerance range along other points along the well plan.

In some embodiments, the top drive control system 220 includes the top drive 140, the speed sensor 140*b*, the torque sensor 140*a*, and the hook load sensor 140*c*. The top drive control system 220 is not required to include the top drive 140, but instead may include other drive systems, such as a power swivel, a rotary table, a coiled tubing unit, a downhole motor, and/or a conventional rotary rig, among others.

In some embodiments, the mud pump control system 225 includes a mud pump controller and/or other means for controlling the flow rate and/or pressure of the output of the mud pump 181.

In some embodiments, the draw works control system 230 includes the draw works controller and/or other means for controlling the feed-out and/or feed-in of the drilling line 125. Such control may include rotational control of the draw works (in v. out) to control the height or position of the hook 135 and may also include control of the rate the hook 135 ascends or descends.

The plurality of sensors 210 may include the ROP sensor 130*a*; the torque sensor 140*a*; the quill speed sensor 140*b*; the hook load sensor 140*c*; the surface casing annular pressure sensor 187; the downhole annular pressure sensor 170*a*; the shock/vibration sensor 170*b*; the toolface sensor 170*c*; the MWD WOB sensor 170*d*; the mud motor delta pressure sensor; the bit torque sensor 172*b*; the hook position sensor; a rotary RPM sensor; a quill position sensor; a pump pressure sensor; a MSE sensor; a bit depth sensor; and any variation thereof. The data detected by any of the sensors in the plurality of sensors 210 may be sent via electronic signal to the controller 190 via wired or wireless transmission. The functions of the sensors 130*a*, 140*a*, 140*b*, 140*c*, 187, 170*a*, 170*b*, 170*c*, 170*d*, 172*a*, and 172*b* are discussed above and will not be repeated here.

Generally, the rotary RPM sensor is configured to detect the rotary RPM of the drill string 155. This may be measured at the top drive 140 or elsewhere, such as at surface portion of the drill string 155.

Generally, the quill position sensor is configured to detect a value or range of the rotational position of the quill 145, such as relative to true north or another stationary reference.

Generally, the pump pressure sensor is configured to detect the pressure of mud or fluid that powers the BHA 170 at the surface or near the surface.

Generally, the MSE sensor is configured to detect the MSE representing the amount of energy required per unit volume of drilled rock. In some embodiments, the MSE is not directly sensed, but is calculated based on sensed data at the controller 190 or other controller.

Generally, the bit depth sensor detects the depth of the bit 175.

In some embodiments the top drive control system 220 includes the torque sensor 140*a*, the quill position sensor, the hook load sensor 140*c*, the pump pressure sensor, the MSE sensor, and the rotary RPM sensor, and a controller and/or other means for controlling the rotational position, speed and direction of the quill or other drill string component coupled to the drive system (such as the quill 145 shown in FIG. 1). The top drive control system 220 is configured to receive a top drive control signal from the drilling module 212, if not also from other components of the apparatus 100.

The top drive control signal directs the position (e.g., azimuth), spin direction, spin rate, and/or oscillation of the quill 145.

In some embodiments, the draw works control system 230 comprises the hook position sensor, the ROP sensor 130*a*, and the draw works controller and/or other means for controlling the length of drilling line 125 to be fed-out and/or fed-in and the speed at which the drilling line 125 is to be fed-out and/or fed-in.

In some embodiments, the mud pump control system 225 comprises the pump pressure sensor and the motor delta pressure sensor 172*a*.

Figure 4:
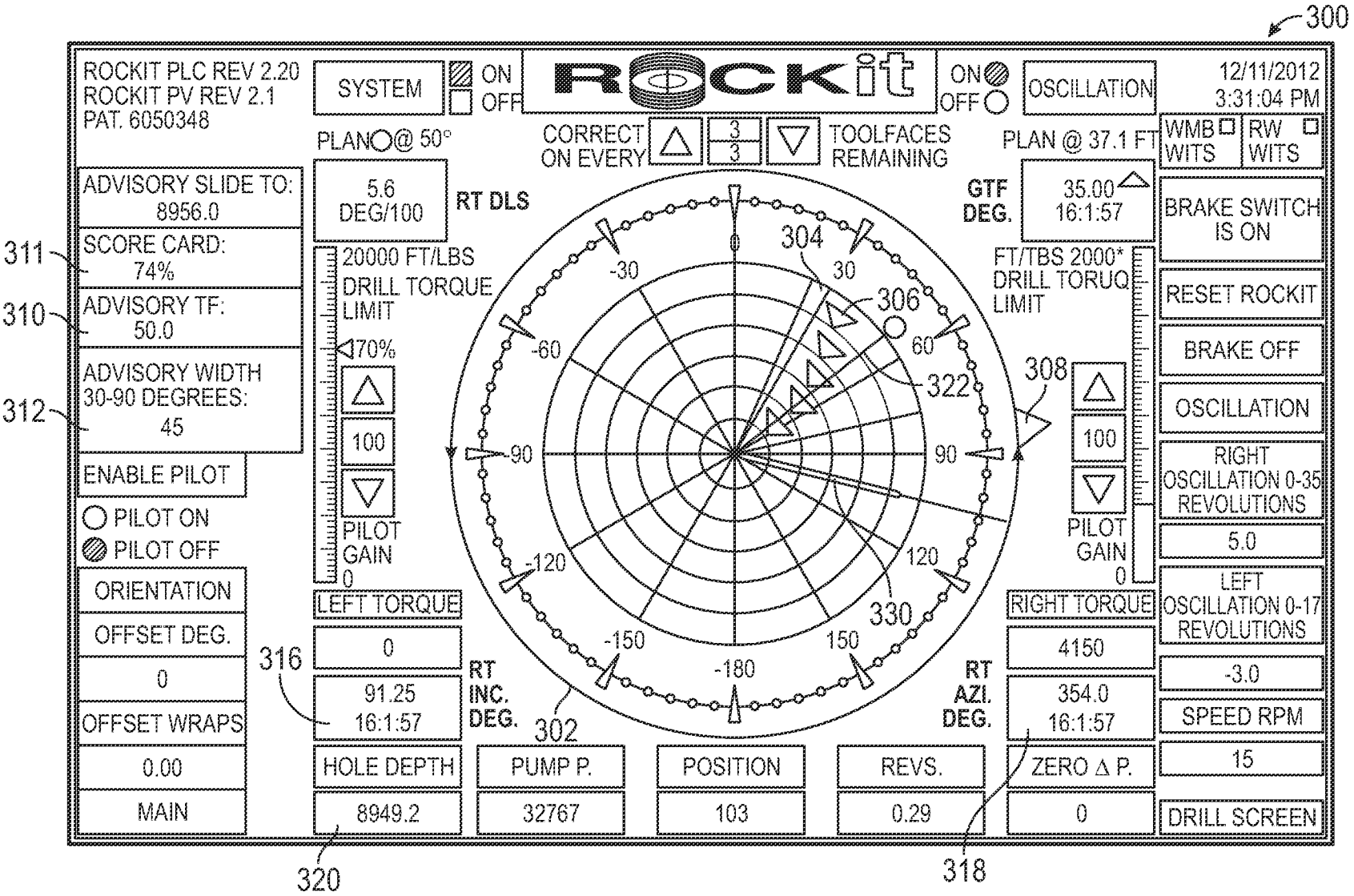
FIG. 4 is a schematic diagram of an example display apparatus showing a two-dimensional visualization, according to one or more aspects of the present disclosure.

FIG. 4 shows a schematic view of a human-machine interface (HMI) 300 according to one or more aspects of the present disclosure. The HMI 300 may be utilized by a human operator during directional and/or other drilling operations to monitor the relationship between toolface orientation and quill position. The HMI 300 may include aspects of the ROCKit® HMI display of Canrig Drilling Technology, LTD. In an example implementation, the HMI 300 is one of several display screens selectably viewable by the user during drilling operations, and may be included as or within the human-machine interfaces, drilling operations and/or drilling apparatus described in the systems herein. The HMI 300 may also be implemented as a series of instructions recorded on a computer-readable medium, such as described in one or more of these references. In some implementations, the HMI 300 is the display 205 of FIG. 2.

The HMI 300 may be accessed by a user, who may be a directional driller operator, while drilling to monitor the status and direction of drilling using the BHA. The directional guidance system 252 of FIG. 2 may drive one or more other human-machine interfaces during drilling operation and may be configured to also display the HMI 300 on the display 205. The directional guidance system 252 driving the HMI 300 may include a "survey" or other data channel, or otherwise includes devices for receiving and/or reading sensor data relayed from the BHA 170, a measurement-while-drilling (MWD) assembly, a RSS assembly, and/or other drilling parameter measurement devices, where such relay may be via the Wellsite Information Transfer Standard (WITS), WITS Markup Language (WITS ML), and/or another data transfer protocol. Such electronic data may include gravity-based toolface orientation data, magnetic-based toolface orientation data, azimuth toolface orientation data, and/or inclination toolface orientation data, among others.

As shown in FIG. 4, the HMI 300 may be depicted as substantially resembling a dial or target shape 302 having a plurality of concentric nested rings. The HMI 300 also includes a pointer 330 representing the quill position. Symbols for magnetic toolface data and gravity toolface data symbols may also be shown. In the example of FIG. 4, gravity toolface angles are depicted as toolface symbols 306. In one example implementation, the symbols for the magnetic toolface data are shown as circles and the symbols for the gravity toolface data are shown as rectangles. Of course, other shapes may be utilized within the scope of the present disclosure. The toolface symbols 306 may also or alternatively be distinguished from one another via color, size, flashing, flashing rate, and/or other graphic elements.

In some implementations, the toolface symbols 306 may indicate only the most recent toolface measurements. However, as in the example implementation shown in FIG. 4, the HMI 300 may include a historical representation of the toolface measurements, such that the most recent measurement and a plurality of immediately prior measurements are displayed. Thus, for example, each ring in the HMI 300 may represent a measurement iteration or count, or a predetermined time interval, or otherwise indicate the historical relation between the most recent measurement(s) and prior measurement(s). In the example implementation shown in FIG. 4, there are five such rings in the dial 302 (the outermost ring being reserved for other data indicia), with each ring representing a data measurement or relay iteration or count. The toolface symbols 306 may each include a number indicating the relative age of each measurement. In the present example, the outermost triangle of the toolface symbols 306 corresponds to the most recent measurement. After the most recent measurement, previous measurements are positioned incrementally towards the center of the dial 302. In other implementations, color, shape, and/or other indicia may graphically depict the relative age of measurement. Although not depicted as such in FIG. 4, this concept may also be employed to historically depict the quill position data. In some implementations, measurements are taken every 10 seconds, although depending on the implementation, measurements may be taken at time periods ranging from every second to every half-hour. Other time periods are also contemplated.

The HMI 300 may also include a number of textual and/or other types of indicators 316, 318, 320 displaying parameters of the current or most recent toolface orientation. For example, indicator 316 shows the inclination of the wellbore, measured by the survey instrument, as 91.25°. Indicator 318 shows the azimuth of the wellbore, measured by the survey instrument as 354°. Indicator 320 shows the hole depth of the wellbore as 8949.2 feet. In the example implementation shown, the HMI 300 may include a programmable advisory width. In the example of FIG. 4, this value is depicted by advisory width sector 304 with an adjustable angular width corresponding to an angular setting shown in the corresponding indicator 312, in this case 45°. The advisory width is a visual indicator providing the user with a range of acceptable deviation from the advisory toolface direction. In the example of FIG. 4, the toolface symbols 306 all lie within the advisory width sector 304, meaning that the user is operating within acceptable deviation limits from the advisory toolface direction. Indicator 310 gives an advisory toolface direction, corresponding to line 322. The advisory toolface direction represents an optimal direction towards the drill plan. Indicator 308, shown in FIG. 4 as an arrow on the outermost edge of the dial 302, is an indicator of the overall resultant direction of travel of the toolface. This indicator 308 may present an orientation that averages the values of other indicators 316, 318, 320. Other values and depictions are included on the HMI 300 that are not discussed herein. These other values include the time and date of drilling, aspects relating to the operation of the drill, and other received sensor data. In some implementations, the HMI 300 is configured to display a drilling score 311, such as a slide stability score.

Figure 5:
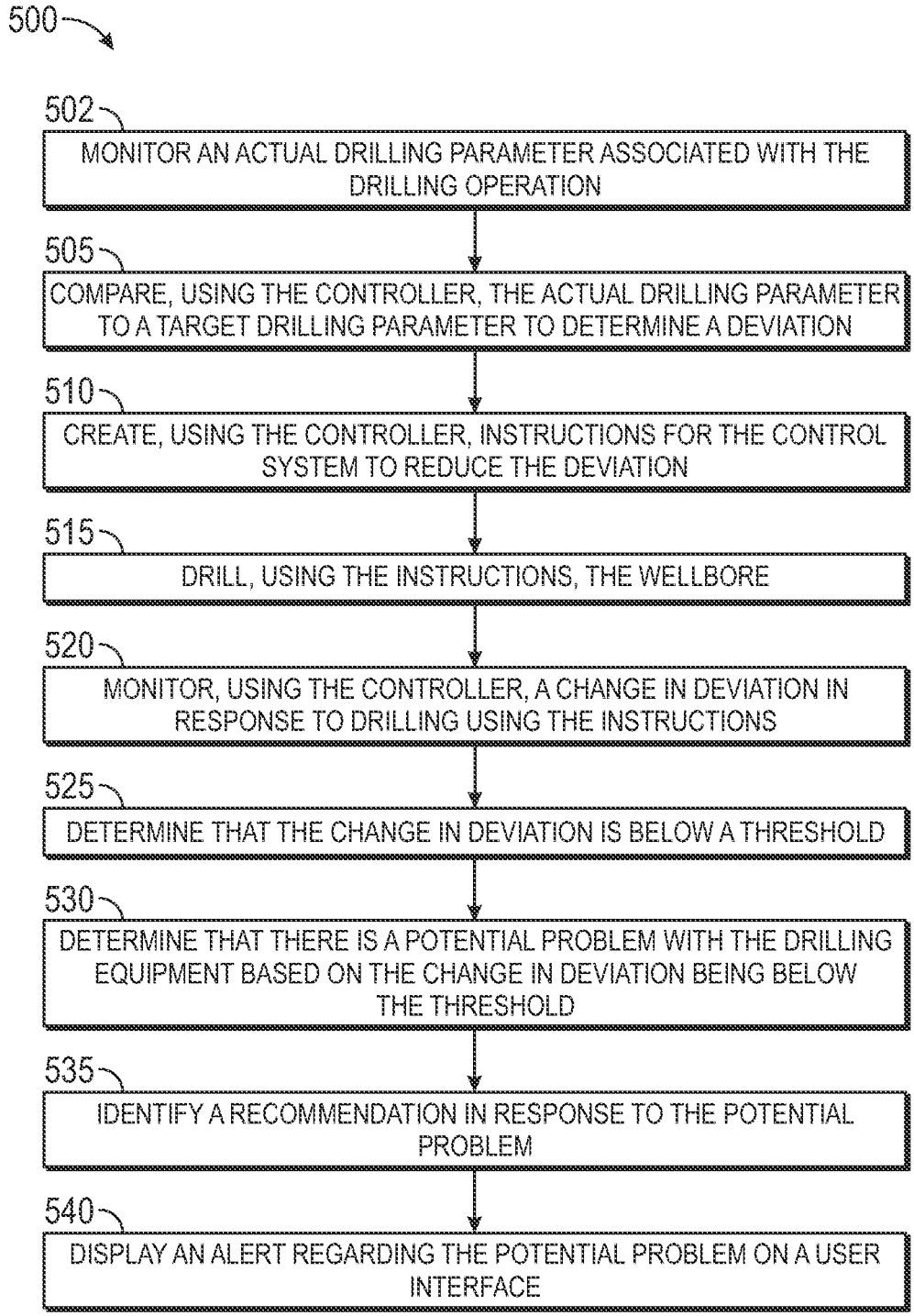
FIG. 5 is a flow-chart diagram of a method according to one or more aspects of the present disclosure.

FIG. 5 is a flow chart showing an example method 500 of using the apparatus 100 to identify a potential problem with drilling equipment that is used in a drilling operation. It is understood that additional steps can be provided before, during, and after the steps of method 500, and that some of the steps described can be replaced or eliminated for other implementations of the method 500. In an example embodiment, the method 500 includes monitoring an actual drilling parameter associated with the drilling operation at step 502; comparing, using the controller 190, the actual drilling parameter to a target drilling parameter to determine a deviation at step 505; creating, using the controller 190, instructions for the control system to reduce the deviation at step 510; drilling, using the instructions, the wellbore at step 515; monitoring, using the controller 190, a change in deviation in response to drilling using the instructions at step 520; determining that the change in deviation is below a threshold at step 525; identifying a potential problem with the drilling equipment based on the change in deviation being below the threshold at step 530; identifying a recommendation in response to the potential problem at step 535; and displaying, an alert regarding the potential problem on a user interface at step 540.

In some embodiments and at the step 502, actual drilling parameters are monitored during drilling of the wellbore 60 using the plurality of sensors 210. Generally, during the drilling operation, the drilling module 212 sends control signals to the top drive control system 220, the mud pump control system 225, and the draw works control system 230 to control the drilling operation. In some embodiments, the signals are instructions or based on instructions. The instructions are generally designed to optimize specific drilling parameters. Some drilling parameters are dependent upon multiple variables and thus instructions intended to change these drilling parameters include target setpoints for a variety of variables. For example, instructions intended to change the WOB might include a target setpoint for the top drive control system 220 and a target setpoint for the mud pump control system 225. However, other drilling parameters are not dependent upon multiple variables and thus instructions intended to change these drilling parameters include a target setpoint for that drilling parameter. For example, instructions intended to change the RPM of the drill string 155 includes the target RPM of the drill string 155. Generally, in the step 502, the plurality of sensors 210 monitors the actual drilling parameters during the drilling operation.

In some embodiments and at the step 505, the controller compares the actual drilling parameter to a target drilling parameter to determine a deviation. In some embodiments, the actual drilling parameter is any one or more of: a rate of penetration; a differential pressure; and a toolface. Each of the actual drilling parameter and the target drilling parameter may be a calculation that is indicative of drilling performance or may be a value detected by the plurality of sensors 210. In some embodiments, the deviation is the difference between the target drilling parameter and the actual drilling parameter.

In some embodiments and at the step 510, the controller creates instructions for the control system 220, 225, and/or 230 to reduce the deviation. In some embodiments, the step 510 includes generating revised or new instructions in response to the deviation. The instructions may be selected by the controller 190 via the execution of one or more database look-up procedures. The use of an electronic database or other plurality of rules in creating the instructions allows for the controller 190 to react to deviations over time—whether within the subject wellbore or in an offset wellbore that is offset from the subject well—in a consistent manner. As such and in some embodiments, the change in deviation can be predicted.

In some embodiments and at the step 515, the wellbore is drilled using the instructions. Generally, the step 515 is substantially similar to the step 502 except the modified or altered instructions are used to control the drilling operation in the step 515.

In some embodiments and at the step 520, the controller 190 monitors a change in deviation in response to drilling using the instructions. In some embodiments, the step 520 requires the controller 190 to monitor the actual drilling parameter while drilling using the instructions and compare the actual drilling parameter to the target drilling parameter to determine the new deviation in order to calculate the change in deviation. Generally, the change in deviation relates to the responsiveness of the drilling equipment when drilling progresses using the instructions created in step 510.

In some embodiments and at the step 525, the controller 190 determines if the change in deviation is below a threshold. Generally, the threshold is based on a predicted or expected change in deviation. In some embodiments, the threshold is a minimum expected change in deviation. The threshold may be based on historical changes in the deviation when similar drilling equipment was used in a drilling operation that used similar instructions. As the change in deviation is associated with the responsiveness of the drilling equipment, the change in deviation being below the threshold indicates that the responsiveness of the drilling equipment is less than expected. One example is when the target drilling parameter is a target ROP. When the actual ROP declines such that there is a deviation between target ROP and the actual ROP, the controller 190 sends instructions to correct the deviation. If, historically, the change in deviation was reduced by a specific percentage in response to drilling using the new instructions, then threshold may be the specific percentage. Another example is when the target drilling parameter is a target differential pressure for a given weight on bit. When the actual differential pressure declines such that there is a deviation between target and actual differential pressures, the controller 190 sends instructions to correct the deviation. If, historically, the change in deviation was reduced by a specific percentage in response to drilling using the new instructions, then threshold may be the specific percentage. A similar example involves the target drilling parameter relating to toolface control precision. The historical data referenced may be data created during the drilling of the wellbore 60 and/or data created during the drilling of an offset wellbore that is offset from the wellbore. The threshold may be included in the drill plan, and as noted above, may take into account previous or concurrent drilling operations. In some embodiments and when the threshold is based on a historical change in deviation, the threshold is also based on the actual drilling parameters from which the deviation and change in deviation are derived.

In some embodiments and at the step 530, the controller identifies a potential problem with the drilling equipment based on the change in deviation being below the threshold. Generally, the term "drilling equipment" refers to any combination of the lifting gear, the draw works 130, the hook 135, the quill 145, the top drive 140, the saver sub 150, a portion or the entirety of the drill string 155, the BHA 170 or any equipment forming a portion of the BHA 170, the drill bit 175, the mud pump(s) 181, the BOP 186, the controller 190, and the plurality of sensors 210. In some embodiments, the potential problem is the use of nonoptimal equipment. For example, when the offset well was drilled using a first BHA combination and the subject well is being drilling using a second BHA combination, and when the first and second BHAs are subjected to nearly identical drilling conditions, then the responsiveness of the second BHA being less than to the first BHA is due to the difference in BHA combinations. Considering the instructions provided by the controller 190 is identical or nearly identical during the drilling of both wellbores, the differences in equipment selection becomes comparable. As such, the problem may be the use of one or more components of the second BHA.

However, the problem may also be deterioration or damage of drilling equipment. If the responsiveness of the drilling equipment decreases over time, then it may be an indication of the deterioration of the drilling equipment or that the drilling equipment is damaged. Generally, the controller 190 identifies the specific drilling equipment that is associated with the problem. For example, the controller 190 may identify the drill bit, the mud motor, stabilizer, flex collar, etc. as the piece of equipment that is associated with the potential problem.

In some embodiments and at the step 535, the controller identifies a recommendation in response to the potential problem. When the potential problem is deterioration of the mud motor, the recommendation may include tripping out to replace the mud motor, altering the instructions to account for the deteriorated state of the mud motor, or altering the instructions to account for the deteriorated state of the mud motor until the next trip out at which time the mud motor may be replaced. For example, when the bit 175 or other component of the BHA 170 deteriorates, control and responsiveness is reduced. As such, the controller 190 may prioritize precision over speed or other performance indicators when creating instructions or the recommendation. Similar recommendations may be made for a deteriorated or damaged drilling bit. When the drilling equipment is damaged or deteriorated, then the drilling equipment may be replaced with the same type of drilling equipment. However, and when the problem is the use of drilling equipment that is not optimum or ideal for the drilling operation, then the instructions may include replacing the drilling equipment with a different type of drilling equipment. In some embodiments, the controller 190 weighs the average or predicted time required to trip out the drill string 155 and replace the drilling equipment with the predicted increase in performance with the recommended change in drilling equipment. As such, the predicted benefits are weighed against the disadvantages of implementing a potential recommendation before the controller identifies a final recommendation. In some embodiments, and when suboptimal drilling equipment is used, this information is stored and used when selecting drilling equipment for a different well. That is, when changing drilling equipment during the drilling operation may not be worth the predicted improvement in performance, the determination that the drilling equipment is suboptimal for the drilling operation or similar drilling operation is used when selecting drilling equipment for future drilling operations.

Figure 6:
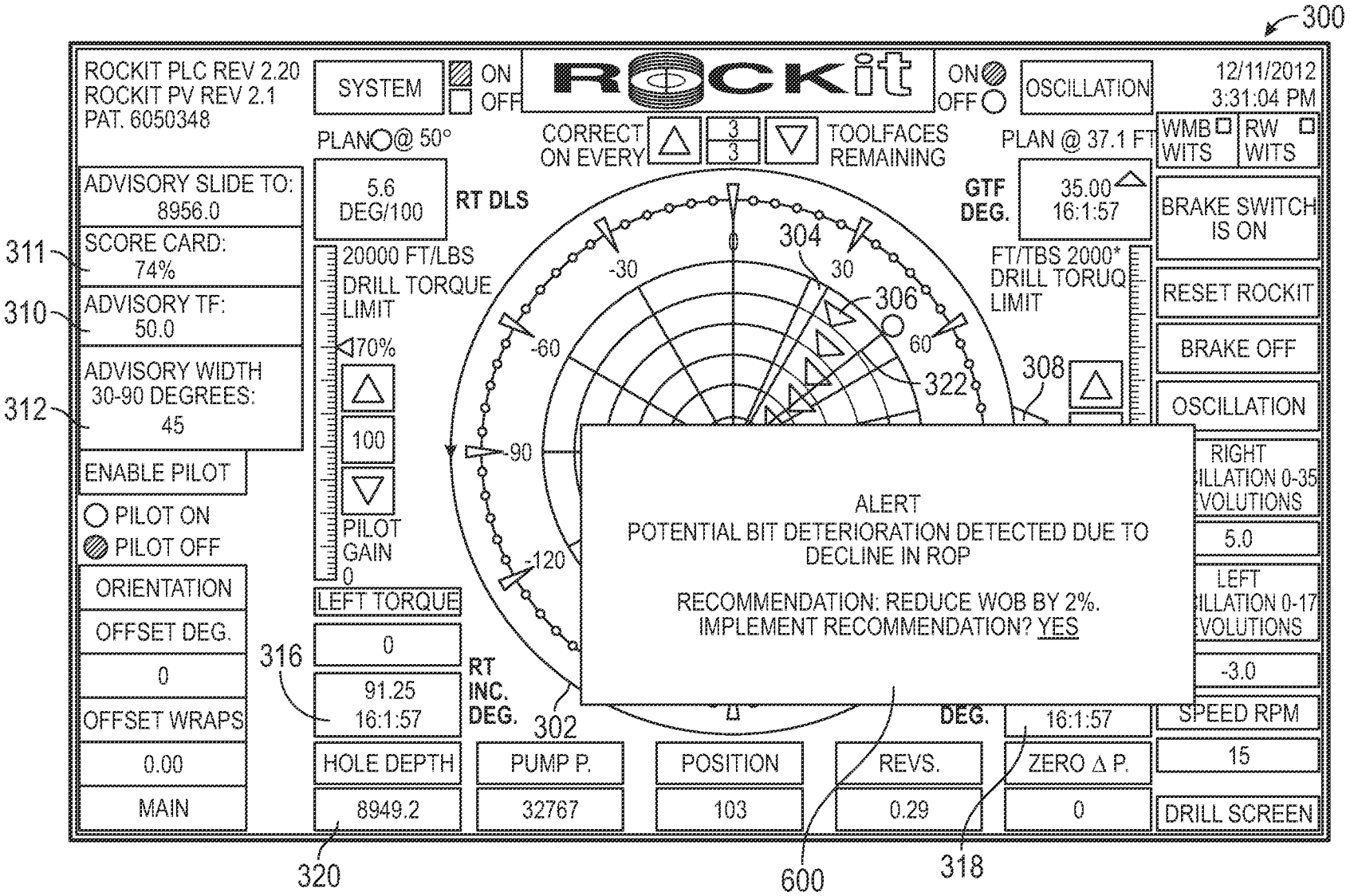
FIG. 6 is a schematic diagram of the display apparatus of FIG. 4 showing a two-dimensional visualization and an alert, according to one or more aspects of the present disclosure.
Figure 7:
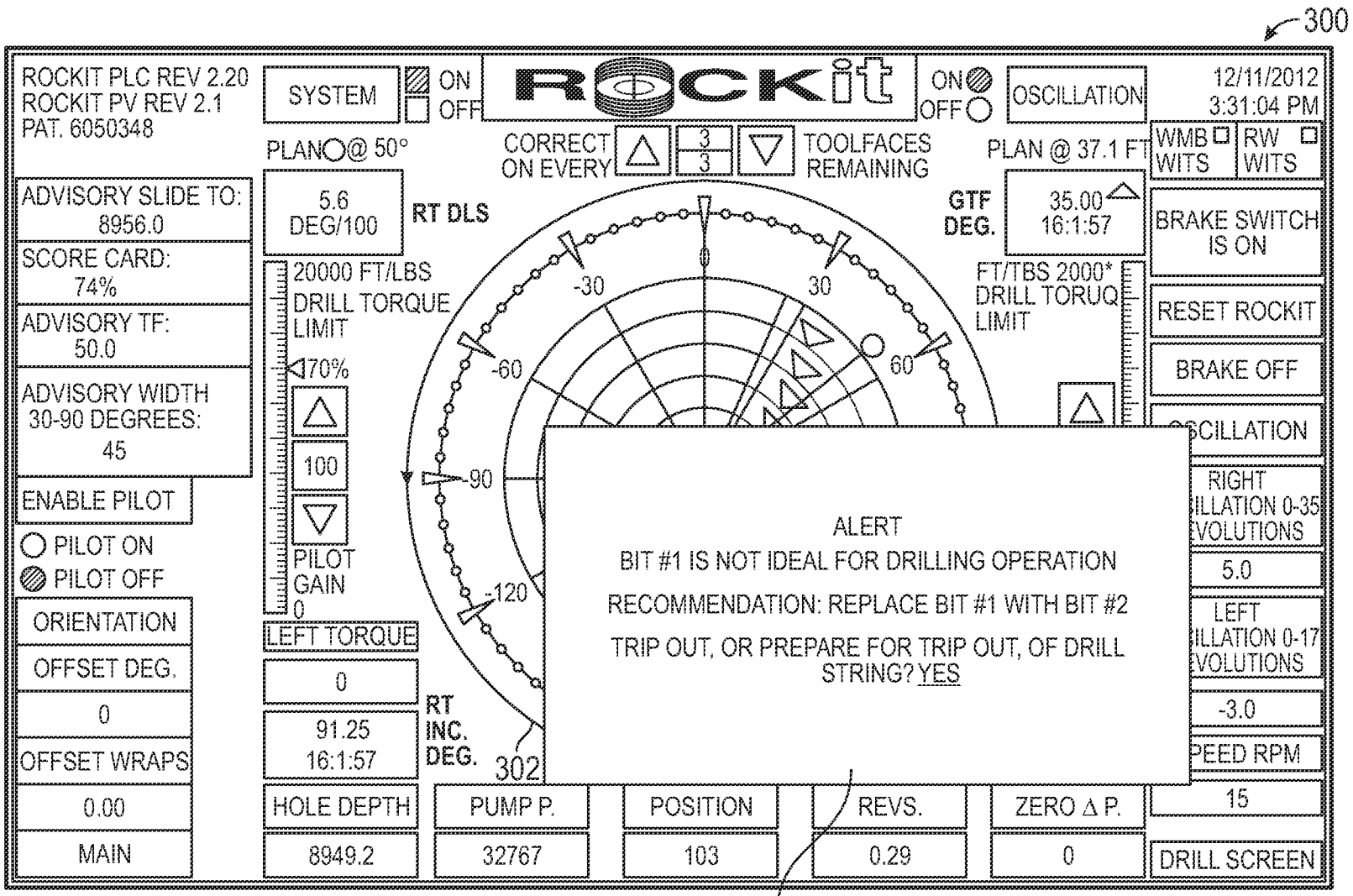
FIG. 7 is a schematic diagram of the display apparatus of FIG. 4 showing a two-dimensional visualization and another alert, according to one or more aspects of the present disclosure.

In some embodiments and at the step 540, an alert is displayed regarding the potential problem on the display 205. In some embodiments, and as illustrated in FIG. 6, the alert is displayed as a pop-up window 600. As illustrated, the pop-up window 600 describes the potential problem, which is potential bit deterioration, and a basis for the identification of the potential problem, which is decline in ROP. In some embodiment, the alert includes the recommendation in response to the potential problem. As illustrated, the pop-up window 600 includes a recommendation to reduce the WOB by 2%. Moreover, in some embodiments, the pop-up window 600 includes a selectable link that, when selected, implements the recommendation. As illustrated, the pop-up window 600 includes a selectable link (i.e., "YES"), that when selected, automatically updates the instructions to comply with the recommendation. However, and as the controller 190 is configured to implement the drilling operation without human input during the drilling operation, the selectable tab may be omitted and the controller 190 may automatically implement the recommendation. In some embodiments, the controller 190 automatically implements a certain type of recommendation but requests human input regarding other types of recommendations. For example, the controller 190 automatically generates instructions implementing recommendations when the recommendations are to update operating or drilling parameters. However, when the recommendation is to change drilling equipment, the controller 190 displays the recommendation and allows the human operator to determine whether to change the drilling equipment. For example, and as illustrated in FIG. 7, a pop-up window 700 includes the alert that indicates the potential problem, which is that Bit #1 is not ideal for the drilling operation, and includes the recommendation to replace Bit #1 with Bit #2. The pop-up window 700 includes a prompt regarding tripping out of the drill string 155. In some embodiments, selecting the "YES" tab will instruct the controller 190 to trip out, or prepare for tripping out, the drill string. While the recommendation is illustrated as being delivered to the via the display or HMI 300 in FIGS. 6 and 7, the recommendation may also be delivered through connected rig or cloud IT systems (e.g. RigCloud). In some embodiments, the pop-up window 700 includes a selectable link that, when selected, opens another window on the user interface that includes data related to the recommendation.

Generally, and as described, the apparatus 100 and method 500 relate to slide drilling automation, analysis automation, and related methodologies being used to conduct downhole equipment condition diagnostics, or downhole equipment performance assessments. The use of the apparatus 100, which enables the elimination of human variability from the slide drilling process, enables changes in drilling performance and precision to be accurately attributed to changes in equipment condition, or to different equipment. This information can be used proactively to alter drilling parameters or automation configurations to prolong the life of downhole equipment, or reactively to 1) change drilling parameters to maximize drilling performance, or 2) recommend actions to change equipment.

Conventionally, and when conducting slide drilling without automation, steering control of the BHA 170 is conducted by a human Directional Driller (DD), thus introducing substantial variability into the control process between discrete slides, hole sections, wells, locations, and directional drillers. Slide drilling automation, via the controller 190, behaves consistently. For a common set of parameter inputs (e.g., weight on bit, differential pressure, top drive RPM) and system configuration, the apparatus 100 will produce an identical equipment control response. Effectively, automation serves to eliminate a key variable from the slide drilling process. The elimination of this human input variable allows changes in performance to be better attributed to differences in downhole drilling equipment. For a single equipment assembly, drilling performance (e.g., rate of penetration, precision of toolface control, differential pressure quantity at given weight on bit, stability of differential pressure measurement) can be evaluated over time to indicate a deterioration in downhole equipment condition. For a comparison between two different equipment assemblies, drilling performance can be compared to indicate relative effectiveness of each equipment assembly.

Using the apparatus 100 and focusing on one well being drilled using a BHA, because human variability has been removed from the system, a decrease in drilling performance output may be attributed to a deterioration in downhole equipment condition (e.g., bit or mud motor). For example, a decline in rate of penetration would be attributed to a deterioration in bit condition. This information would be used diagnostically by the controller 190 to recommend either a change in drilling parameters to either prolong the life of the bit or improve the rate of performance, or recommend that the bit be replaced with fresh equipment. A decline in differential pressure for a given weight on bit would be attributed to a deterioration in mud motor condition. A decline in the stability of the differential pressure measurement (i.e. the measurement becomes more erratic) for a given weight on bit would be attributed to a deterioration in mud motor condition. This information would be used diagnostically by the controller 190 as outlined above.

The apparatus 100 is also useful, as noted above, when two wells are being drilled in close geographic proximity (i.e., same pad) with BHAs identical except for one component (e.g., bit, mud motor, stabilizer, flex collar). Identical drilling parameters (e.g., weight on bit, differential pressure, top drive RPM) and automation configurations (e.g., steering methodologies) are used at common depths for both BHA runs. In this example, because human variability has been removed from the drilling operation, differences in performance output can be accurately attributed to the different component. Performance data for the subject and offset well(s) would be considered when making diagnostic recommendations regarding drilling parameters, automation system configuration, or equipment usage. For example, decreased rate of penetration from offset to subject well would be attributed to the difference in downhole equipment. This information would be used diagnostically by the apparatus 100 to recommend either a change in drilling parameters to improve subject well performance to the offset well, or to recommend a change in equipment. In another example, decreased toolface control precision from offset to subject well would be attributed to the difference in downhole equipment. This information would be used to recommend either a change in drilling parameters or automation system configurations to improve subject well performance to the offset well, or to recommend a change in equipment.

Figure 8:
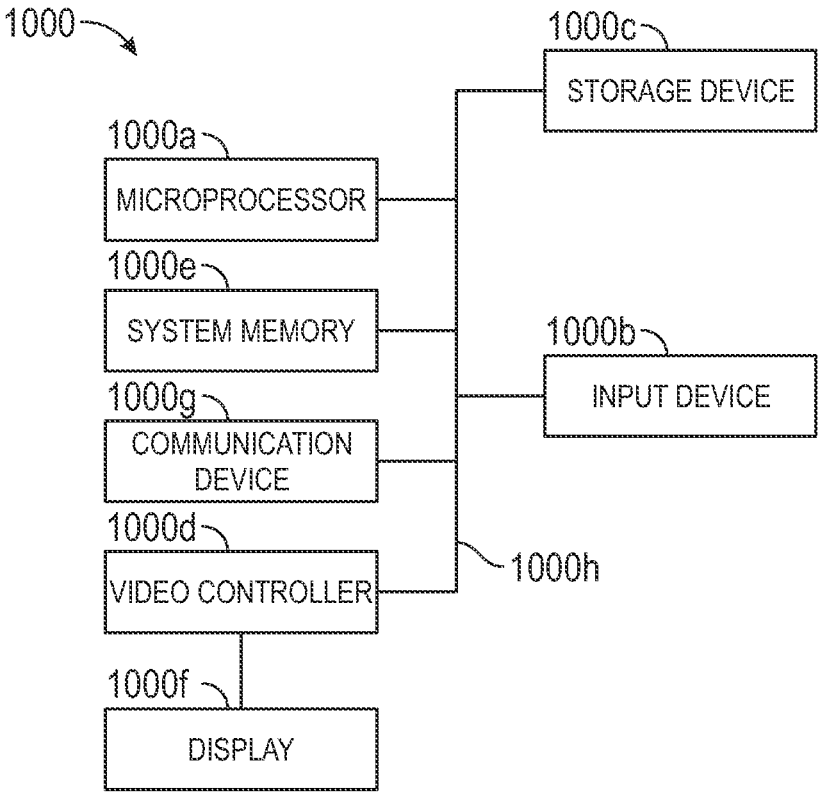
FIG. 8 is a diagrammatic illustration of a node for implementing one or more example embodiments of the present disclosure, according to an example embodiment.

In an example embodiment, as illustrated in FIG. 8 with continuing reference to FIGS. 1-7, an illustrative node 1000 for implementing one or more of the example embodiments described above and/or illustrated in FIGS. 1-7 is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In several example embodiments, the storage device 1000*c* may include a floppy drive, hard drive, CD-ROM, optical drive, any other form of storage device and/or any combination thereof. In several example embodiments, the storage device 1000*c* may include, and/or be capable of receiving, a floppy disk, CD-ROM, DVD-ROM, or any other form of computer-readable medium that may contain executable instructions. In several example embodiments, the communication device 1000*g* may include a modem, network card, or any other device to enable the node to communicate with other nodes. In several example embodiments, any node represents a plurality of interconnected (whether by intranet or Internet) computer systems, including without limitation, personal computers, mainframes, PDAs, smartphones and cell phones.

In several example embodiments, one or more of the components of the systems described above and/or illustrated in FIGS. 1-7 include at least the node 1000 and/or components thereof, and/or one or more nodes that are substantially similar to the node 1000 and/or components thereof. In several example embodiments, one or more of the above-described components of the node 1000, the system 10, and/or the example embodiments described above and/or illustrated in FIGS. 1-7 include respective pluralities of same components.

In several example embodiments, one or more of the applications, systems, and application programs described above and/or illustrated in FIGS. 1-7 include a computer program that includes a plurality of instructions, data, and/or any combination thereof; an application written in, for example, Arena, HyperText Markup Language (HTML), Cascading Style Sheets (CSS), JavaScript, Extensible Markup Language (XML), asynchronous JavaScript and XML (Ajax), and/or any combination thereof; a web-based application written in, for example, Java or Adobe Flex, which in several example embodiments pulls real-time information from one or more servers, automatically refreshing with latest information at a predetermined time increment; or any combination thereof.

In several example embodiments, a computer system typically includes at least hardware capable of executing machine readable instructions, as well as the software for executing acts (typically machine-readable instructions) that produce a desired result. In several example embodiments, a computer system may include hybrids of hardware and software, as well as computer sub-systems.

In several example embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several example embodiments, hardware may include any physical device that is capable of storing machine-readable instructions, such as memory or other data storage devices. In several example embodiments, other forms of hardware include hardware sub-systems, including transfer devices such as modems, modem cards, ports, and port cards, for example.

In several example embodiments, software includes any machine code stored in any memory medium, such as RAM or ROM, and machine code stored on other devices (such as floppy disks, flash memory, or a CD ROM, for example). In several example embodiments, software may include source or object code. In several example embodiments, software encompasses any set of instructions capable of being executed on a node such as, for example, on a client machine or server.

In several example embodiments, combinations of software and hardware could also be used for providing enhanced functionality and performance for certain embodiments of the present disclosure. In an example embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several example embodiments, computer readable mediums include, for example, passive data storage, such as a random access memory (RAM) as well as semi-permanent data storage such as a compact disk read only memory (CD-ROM). One or more example embodiments of the present disclosure may be embodied in the RAM of a computer to transform a standard computer into a new specific computing machine. In several example embodiments, data structures are defined organizations of data that may enable an embodiment of the present disclosure. In an example embodiment, a data structure may provide an organization of data, or an organization of executable code.

In several example embodiments, any networks and/or one or more portions thereof may be designed to work on any specific architecture. In an example embodiment, one or more portions of any networks may be executed on a single computer, local area networks, client-server networks, wide area networks, internets, hand-held and other portable and wireless devices and networks.

In several example embodiments, a database may be any standard or proprietary database software. In several example embodiments, the database may have fields, records, data, and other database elements that may be associated through database specific software. In several example embodiments, data may be mapped. In several example embodiments, mapping is the process of associating one data entry with another data entry. In an example embodiment, the data contained in the location of a character file can be mapped to a field in a second table. In several example embodiments, the physical location of the database is not limiting, and the database may be distributed. In an example embodiment, the database may exist remotely from the server, and run on a separate platform. In an example embodiment, the database may be accessible across the Internet. In several example embodiments, more than one database may be implemented.

In several example embodiments, a plurality of instructions stored on a computer readable medium may be executed by one or more processors to cause the one or more processors to carry out or implement in whole or in part the above-described operation of each of the above-described example embodiments of the system, the method, and/or any combination thereof. In several example embodiments, such a processor may include one or more of the microprocessor 1000*a*, any processor(s) that are part of the components of the system, and/or any combination thereof, and such a computer readable medium may be distributed among one or more components of the system. In several example embodiments, such a processor may execute the plurality of instructions in connection with a virtual computer system. In several example embodiments, such a plurality of instructions may communicate directly with the one or more processors, and/or may interact with one or more operating systems, middleware, firmware, other applications, and/or any combination thereof, to cause the one or more processors to execute the instructions.

In several example embodiments, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several example embodiments, while different steps, processes, and procedures are described as appearing as distinct acts, one or more of the steps, one or more of the processes, and/or one or more of the procedures may also be performed in different orders, simultaneously, and/or sequentially. In several example embodiments, the steps, processes and/or procedures may be merged into one or more steps, processes, and/or procedures.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations and this is within the contemplated scope of disclosure herein, unless stated otherwise.

The phrase "at least one of A and B" should be understood to mean "A, B, or both A and B." The phrases "one or more of the following: A, B, and C" and "one or more of A, B, and C" should each be understood to mean "A, B, or C; A and B, B and C, or A and C; or all three of A, B, and C."

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Although several example embodiments have been described in detail above, the embodiments described are example only and are not limiting, and those of ordinary skill in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A method of identifying a potential problem with a bottom hole assembly ("BHA") combination that is used in a drilling operation associated with a wellbore, wherein the method comprises:

monitoring, using a sensor, an actual drilling parameter associated with the drilling operation;

comparing, using a controller that is operably coupled to the sensor, the actual drilling parameter to a target drilling parameter to determine a deviation between the actual and target drilling parameters;

creating, using the controller and in response to the deviation, instructions for a control system that controls an aspect of the drilling operation;

wherein the controller is operably coupled to the control system;

wherein the controller, the control system, and the sensor form a feedback control loop system such that the controller creates the instructions to reduce the deviation and causes the control system to implement the instructions;

wherein the controller references an electronic database to create the instructions thereby omitting variability associated with human input in creating the instructions;

monitoring, using the controller, a change in the deviation in response to drilling using the instructions;

determining that the change in the deviation is below a threshold;

wherein the threshold is based on any one or more of: data created during the drilling operation or data associated with an offset wellbore; and wherein the change in the deviation being below the threshold is associated with a decrease in drilling performance; and determining, based on the change in the deviation being below the threshold, that there is a potential problem with the BHA combination.

2. The method of claim 1, wherein the BHA combination comprises a mud motor and a drill bit.

3. The method of claim 2, further comprising identifying, using the controller, a recommendation in response to the potential problem;

wherein the recommendation is to change the mud motor, the drill bit, or both the mud motor and the drill bit.

4. The method of claim 1, wherein the decrease in drilling performance comprises a decrease in toolface control precision and the threshold is based on toolface control precision of the offset wellbore.

5. The method of claim 1, wherein the decrease in drilling performance comprises a decreased rate of penetration and the threshold is based on a rate of penetration of the offset wellbore.

6. The method of claim 2, further comprising identifying, using the controller, a recommendation in response to the potential problem;

wherein the change in deviation relates to a decline in a rate of penetration and the recommendation is to change the drilling bit.

7. The method of claim 2, further comprising identifying, using the controller, a recommendation in response to the potential problem;

wherein the decrease in drilling performance comprises a decline in differential pressure for a given weight on bit and the recommendation is to change the mud motor.

8. The method of claim 2, further comprising identifying, using the controller, a recommendation in response to the potential problem;

wherein the decrease in drilling performance comprises a decline in stability of a differential pressure and the recommendation is to change the mud motor.

9. The method of claim 1, further comprising displaying an alert regarding the potential problem on a user interface, wherein the alert includes a recommendation to modify the instructions.

10. The method of claim 1, further comprising:

identifying, using the controller, a recommendation in response to the potential problem; and implementing, using the controller, the recommendation without waiting for human input.

11. A drilling apparatus configured to identify a potential problem with a bottom hole assembly ("BHA) combination that is used in a drilling operation associated with a wellbore, the apparatus comprising:

a sensor that monitors an actual drilling parameter during the drilling operation;

a control system that controls an aspect of the drilling operation; and a controller that is operably coupled to the sensor, wherein the controller is configured to:

monitor, using the sensor, an actual drilling parameter associated with the drilling operation;

compare the actual drilling parameter to a target drilling parameter to determine a deviation between the actual and target drilling parameters;

create, in response to the deviation, instructions for the control system;

wherein the controller is operably coupled to the control system;

wherein the controller, the control system, and the sensor form a feedback control loop system such that the controller creates the instructions to reduce the deviation and causes the control system to implement the instructions;

wherein the controller references an electronic database to create the instructions thereby omitting variability associated with human input in creating the instructions;

monitor a change in the deviation in response to drilling using the instructions;

determine that the change in the deviation is below a threshold;

wherein the threshold is based on any one or more of: data created during the drilling operation or data associated with an offset wellbore; and wherein the change in the deviation being below the threshold is associated with a decrease in drilling performance; and determine, based on the change in the deviation being below the threshold, that there is a potential problem with the BHA combination.

12. The apparatus of claim 11, wherein the BHA combination comprises a mud motor and a drill bit.

13. The apparatus of claim 12, wherein the controller is further configured to identify a recommendation in response to the potential problem;

wherein the recommendation is to change the mud motor, the drill bit, or both the mud motor and the drill bit.

14. The apparatus of claim 11, wherein the decrease in drilling performance comprises a decrease in toolface control precision and the threshold is based on toolface control precision of the offset wellbore.

15. The apparatus of claim 11, wherein the decrease in drilling performance comprises a decreased rate of penetration and the threshold is based on a rate of penetration of the offset wellbore.

16. The apparatus of claim 12, wherein the controller is further configured to identify a recommendation in response to the potential problem;

wherein the change in deviation relates to a decline in a rate of penetration and the recommendation is to change the drilling bit.

17. The apparatus of claim 12, wherein the controller is further configured to identify a recommendation in response to the potential problem;

wherein the decrease in drilling performance comprises a decline in differential pressure for a given weight on bit and the recommendation is to change the mud motor.

18. The apparatus of claim 12, wherein the controller is further configured to identify a recommendation in response to the potential problem;

wherein the decrease in drilling performance comprises a decline in stability of a differential pressure and the recommendation is to change the mud motor.

19. The apparatus of claim 11, wherein the controller is further configured to display an alert regarding the potential problem on a user interface, wherein the alert includes a recommendation to modify the instructions.

20. The apparatus of claim 11, wherein the controller is further configured to:

identify a recommendation in response to the potential problem; and implement the recommendation without waiting for human input.

* * * * *